US005111211A

United States Patent [19]

Dahlberg

[11] Patent Number: 5,111,211

[45] Date of Patent: May 5, 1992

[54] BROADBAND PATCH ANTENNA

[75] Inventor: Scott E. Dahlberg, St. Peters, Mo.

[73] Assignee: McDonnell Douglas Corporation, Long Beach, Calif.

[21] Appl. No.: 554,360

[22] Filed: Jul. 19, 1990

[51] Int. Cl.[5] ..... H01Q 1/38; H01Q 11/10

[52] U.S. Cl. ..... 343/700 MS; 343/792.5; 343/830

[58] Field of Search ..... 343/700 MS, 792.5, 795, 343/829, 830, 846

[56] References Cited

U.S. PATENT DOCUMENTS 4,063,246 12/1977 Greiser ..... 343/700 MS
4,761,653 8/1988 Owens et al. ..... 343/700 MS

FOREIGN PATENT DOCUMENTS 713168 7/1965 Canada ..... 343/792.5
34384 12/1964 German Democratic Rep. ..... 343/792.5

*Primary Examiner*—Michael C. Wimer
*Attorney, Agent, or Firm*—Gregory A. Cone; John H. Scholl

[57] ABSTRACT

A log periodic antenna of simple, circuit board construction exhibits an average standing wave ratio of less than 2.0 over a broadband frequency characteristic.

19 Claims, 5 Drawing Sheets

FIG. 1.
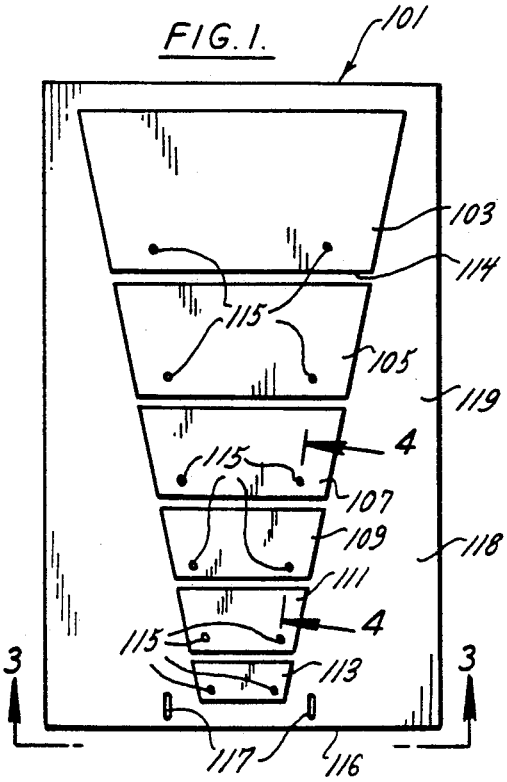
FIG. 2.
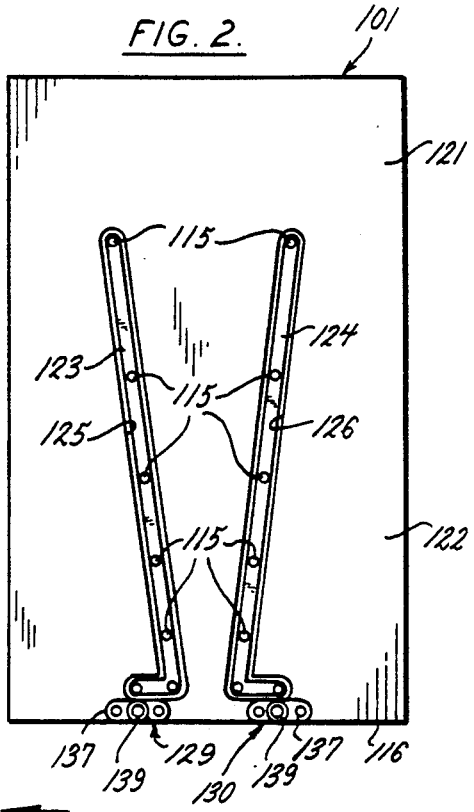
FIG. 3.
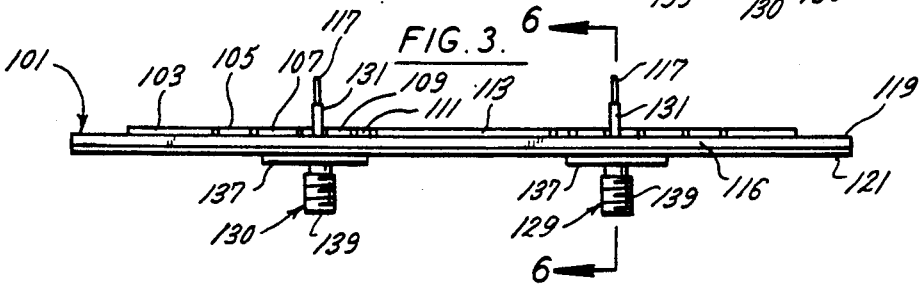
FIG. 4.
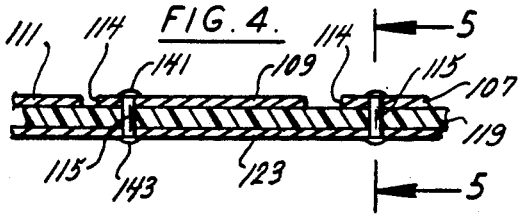
FIG. 5.
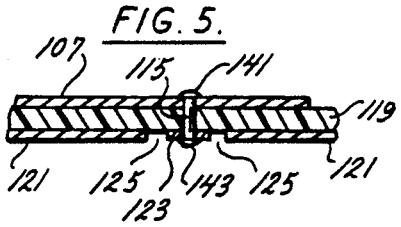
FIG. 6.
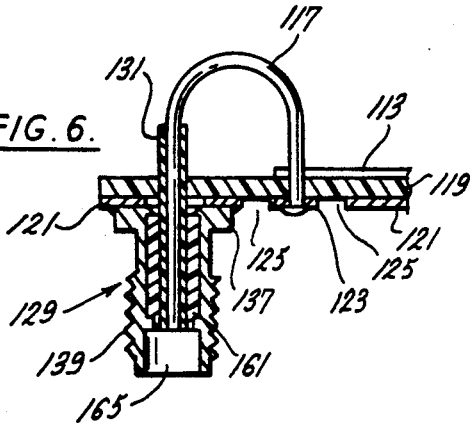
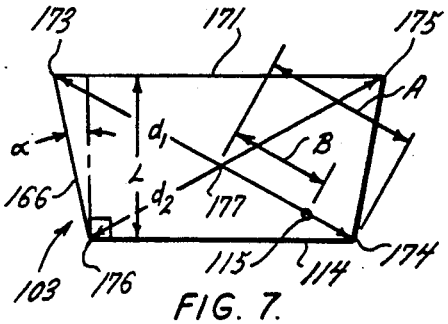
FIG. 7.

BROADBAND PATCH ANTENNA

BACKGROUND OF THE INVENTION

In high frequency applications, the small wavelength of transmitted electromagnetic radiation enables the use of relatively smaller antennas. Within this size niche is the need for antennas having broad band capability. A satellite having a large number of channels operating on different frequencies, for example, would have the need for a compact multi-band antenna. Even though higher frequency antennas are generally smaller, the size and weight limitations on spacecraft would still require the smallest of the smaller antennas.

As frequencies of use in all types of service approach higher and higher levels, the compact size of the transmitting/receiving array enables an ever increasing number of uses. In the oil reservoir exploration field, the ability to electromagnetically characterize the surrounding strata, especially with a wide band of frequencies, would be especially advantageous. The size and bandwidth of the antenna directly relate to such usefulness since both the transmitting and receiving array must be able to fit in the borehole.

In spread spectrum service, an antenna with a wide band wavelength characteristic would eliminate the need for simultaneous use of several different antennas.

For example, U.S. Pat. No. 3,110,030 to Cole, Jr, entitled "Cone Mounted Logarithmic Dipole Array Antenna" discloses antenna united for use on an aerodynamic vehicle.

U.S. Pat. No. 3,286,268 to Barbano, entitled "Log Periodic Antenna With Parasitic Elements Interspersed In Log Periodic Manner" discloses improved log periodic dipole and monopole antenna arrays and broadband antennas.

U.S. Pat. No. 3,308,470 to Bell, entitled "Tapered Ladder Log Periodic Antenna" discloses a symmetrical antenna of the log-periodic type.

U.S. Pat. No. 3,369,243 to Greiser, entitled "Log-Periodic Antenna Structure" discloses a wide band folded element type antenna structure having a plurality of series fed folded elements varying in length and spacing, and a series of phasing elements allowing control of the phase progression of the element currents.

U.S. Pat. No. 3,101,474 to Wickersham, Jr. et al., entitled "Log Periodic Type Antenna Mounted On Ground Plane And Fed By Tapered Feed" discloses a broadband "tapered" array utilizing radiating elements whose lengths are functions of element position in the array.

U.S. Pat. No. 3,500,424 to Barbano et al., entitled "Furlable Antenna" discloses planar conductive patterns comprising dipole radiating elements and feed lines of the antenna formed by printed circuit techniques on the same side of a flexible nylon sheet.

U.S. Pat. No. 3,543,277 to Pullara, entitled "Reduced Size Broadband Antenna" discloses an improved reduced size log periodic antenna in which selected elements are successively loaded to reduce the resonant frequency of such selected elements, thus to provide a desirable overall reduction in operating frequency of the antenna as compared to the lowest operating frequency of prior art antenna of similar size, while maintaining essentially frequency-independent performance over a very wide frequency range.

U.S. Pat. No. 3,550,143 to Grant, entitled "Multiple Tooth Log-Periodic Trapezoidal Array" discloses antenna arrays for use in transmission or reception wherein a novel multiple tooth trapezoidal array having multiple tapered zones is arranged in such a manner as to obtain high impedance, low capacitive coupling, and a unidirectional radiation pattern exhibiting higher gain and broad band response as compared with conventional techniques.

U.S. Pat. No. 3,633,207 to Ingerson et al., entitled "Modulated Impedance Feeding System For Log-Periodic Antennas" discloses a broadband feed system for log-periodic antennas, including loading elements, a transmission line to couple energy to or from the elements, and impedance-modulating means for matching the image impedances of the transmission line and the loading elements in the regions of local reflections to realize essentially frequency independent performance.

U.S. Pat. No. 4,101,895 to Jones, Jr., entitled "Multifrequency Antenna System Integrated Into A Radome" discloses an antenna system that comprises two or more linear arrays within close proximity which can be integrated into a conical dielectric radome.

U.S. Pat. No. 4,594,595 to Struckman, entitled "Circular Log-Periodic Direction-Finder Array" discloses a circular frequency-independent antenna array including a plurality of radially extending log-periodic subarrays of slot radiators provided in a ground-plane conductor.

U.S. Pat. No. 4,652,889 to Bizourard et al., entitled "Plane Periodic Antenna" discloses a plane periodic antenna that comprises a conductive plate having radiating elements formed from two lines of flat teeth.

U.S. Pat. No. 4,616,233 to Westerman, entitled "Twin Zig Zag Log Periodic Antenna" discloses a log periodic antenna comprising two substantially identical nonresonant elongated log periodic conductive zig zag structures.

UK Patent Application No. 2 064 877 A to Hall, entitled "Microstrip Antenna" discloses a wide band log periodic microstrip antenna comprising a feedline having a succession of conducting sheet radiators spaced along it from the input end.

All antenna designs involve a degree of tradeoff between size and gain, but broadband antennas involve a trade off between the gain sacrificed by departing from a virtually infinite array of single frequency antennas to arrive at a single structure which will adequately receive a wide frequency band of electromagnetic radiation. While maximizing the signal power received in the wide frequency band.

SUMMARY OF THE INVENTION

The antenna of the present invention has a wide bandwidth, small size, and compact element shape. The element shape and orientation optimizes the received signal power. The antenna is capable of receiving radio frequency signals in excess of two octive range. The antenna performs well in receiving either linearly or circularly polarized signals.

The reduced thickness of the antenna enables shaping to fit either flat or curved surfaces. Its low profile enables flush mounting in a space of small depth. Typically, construction may be derived from printed circuit board material, enabling cost effective mass production.

BRIEF DESCRIPTION OF THE DRAWINGS

The structure and method of operation of the invention, together with additional advantages thereof, will be best understood from the following description of specific embodiments when read in connection with the accompanying drawings, in which:

FIG. 1 is a front view of the antenna of the present invention illustrating the trapezoidally shaped radiative elements;

FIG. 2 is a rear view illustration of the antenna shown in FIG. 1, illustrating the feed orientation for the radiative elements shown in FIG. 1;

FIG. 3 is a bottom cross-sectional view taken at 3—3 of FIG. 1;

FIG. 4 is a side cross-sectional view taken at line 4—4 of FIG. 1 illustrating the details of support and feed of the antenna elements;

FIG. 5 is a top cross-sectional view taken at line 5—5 of FIG. 4 illustrating further details of support of the antenna elements shown in FIG. 1;

FIG. 6 is a side cross-sectional view taken at line 6—6 of FIG. 3, illustrating the details of the extension of the feed through loop extending out of and back into the support structure;

FIG. 7 is a geometric representation of a single antenna element;

DETAILED DESCRIPTION OF THE PREFERRED EMBODIMENT

Figure 8:
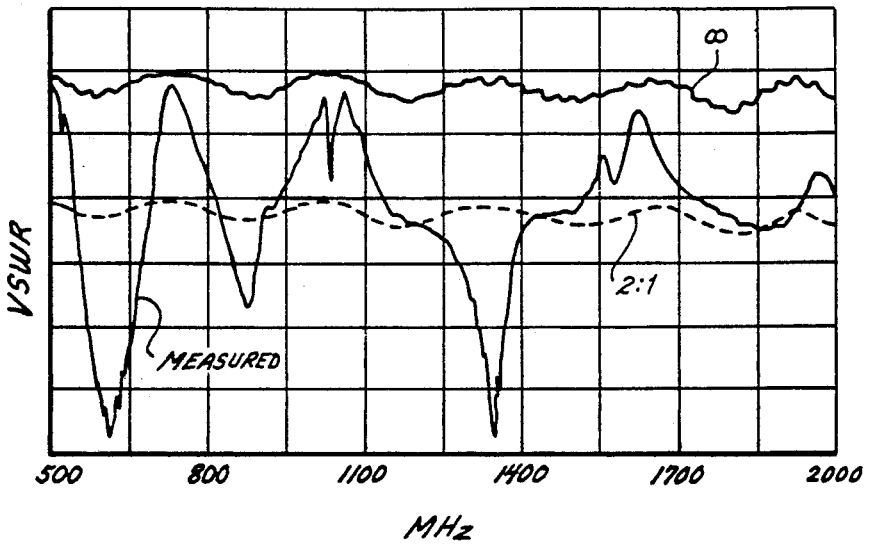
FIG. 8 is a plot of the voltage standing wave ratio versus frequency with two feed ports connected.

Referring to FIG. 1, a front view of the antenna 101 of the present invention is illustrated. Six trapezoidally shaped successively smaller radiative elements, 103, 105, 107, 109, 111, and 113 are included on the antenna 101. Each of the elements 103, 105, 107, 109, 111, and 113 are supported near their smaller parallel edge 114 by two connecting pins 115. Near the edge 116 of the antenna 101 adjacent the smallest element 113, a pair of looping transmission lines 117 extend outwardly from and back into the front face 118 of antenna 101. The front face 118 of antenna 101 is formed on a dielectric layer 119.

Referring to FIG. 2, a rear view illustration of the antenna 101 shown in FIG. 1 shows a layer of metallization 121 which covers the majority of the rear surface 122 of the antenna 101. A pair of microstrip feedlines 123 and 124 extend from a point near the edge 116 of antenna 101 in a general "V" orientation. Feedlines 123 and 124 lie adjacent and are surrounded by insulating gaps 125 and 126 respectively which separate feedlines 123 and 124 from metallization layer 121. Feedlines 123 and 124, spaced by the insulating gaps 125 and 126, are attached to the rear surface 122 of antenna 101 by the connecting pins 115. Connecting pins 115, which are also visible in FIG. 1, extend through the dielectric layer 119 of the antenna 101, and electrically connect the feedlines 123 and 124 to the radiative elements 103, 105, 107, 109, 111, and 113 illustrated in FIG. 1.

A pair of coaxial connectors 129 and 130 are fastened to the rear surface 122 of the antenna 101. The connectors 129 and 130 may be of any type depending upon the band of frequencies sought to be used. Typically, at the design frequency of the preferred embodiment, the connectors 129 and 130 can be OSM or SMA type connectors. Note that the insulating gaps 125 and 126 insulate the coaxial connectors 129 and 130 from contact with feedlines 123 and 124 respectively.

Referring to FIG. 3, a bottom view looking into section 3—3 of FIG. 1 is shown. Transmission lines 117 are shown surrounded by an insulating sleeve 131 as transmission lines 117 extend from front face 118. Transmission lines 117 can be uncovered at the portion thereof furthest from the front face 118.

FIG. 3 also better illustrates that antenna 101 is made up of a layer of metallization 121 along the back side shown in FIG. 2, and a layer of dielectric 119 on the front side shown facing the observer in FIG. 1. The coaxial connectors 129 and 130 are shown as having a base plate 137 and a body 139. Also shown is the relative position of the radiative elements 103, 105, 107, 109, 111, and 113 which were illustrated in FIG. 1.

FIG. 4 is a cross-sectional side view taken at line 4—4 of FIG. 1 along the length of microstrip feedline 123, illustrating the details of the attachment of the radiating elements 103, 105, 107, 109, 111, and 113 to the microstrip feedlines 123 and 124. Radiating elements 107, 109 and 111 are shown atop dielectric layer 119 and microstrip feedline 123. Radiating elements 107 and 109, dielectric layer 119, and microstrip feedline 123 are shown held together by connecting pins 115, the pins 115 providing electrical connection between the elements 107 and 109 and the feedline 123.

Referring to FIG. 5, connecting pin 115 is shown as a rivet-like structure having an enlarged end 141 abutting radiating element 107, and a similar enlarged end 143 abutting microstrip feedline 123. FIG. 5 illustrates the relationship between the radiating element 107, one connecting pin 115, and microstrip feedline 123. Conspicuously shown is the gap 125 which separates the metallization layer 121 from the microstrip feedline 123.

FIG. 6 is a side cross-sectional view taken at line 6—6 of FIG. 3 through coaxial connector 129. The transmission line 117 is shown extending from the microstrip feedline 123 into insulating sleeve 131. Insulating sleeve 131 is shown extending into the body 139 of the coaxial connector 129. Within coaxial connector body 139, the insulating sleeve 131 is surrounded by a second insulating sleeve 161. An aperture 165 is shown in coaxial connector body 139. Surrounding the aperture 165 and partially extending along the body 139 of coaxial connector 129 is an externally threaded portion 167. The body 139 is coextensive with the base plate 137. The base plate 137 abuts and electrically contacts the metallization layer 121 to ground the connector 129 thereto.

Referring to FIG. 7, a geometric representation of a typical radiating element 103 is shown. Although element 103 is shown, the dimensional relationships of FIG. 7 apply to all of the elements 103, 105, 107, 109, 111, and 113. Generally, the geometric relationship of radiating element 103, 105, 107, 109, 111, or 113, is a log periodic relationship dictated by the divergent angle $\alpha$, where $\alpha$ is the angle which the side 166 of radiating element 103 makes with respect to the bottom edge 114 thereof. The theory which allows calculation of o was originated by Dysan, Mittra, et al in the 1950's. In one instance of the present antenna, the angle $\alpha$ is approximately 12 degrees. The distance L of radiating element 103, divided by the distance L of the second and next smaller subsequent radiating element, in this case element 105, should equal the distance L of radiating element 105 divided by the distance L of the third next consecutive radiating element, in this case radiative element 107. This sequence holds ad infinitum, but is in the case of the present antenna 101, is halted after the distance L of radiative element 113 is ascertained.

The smallest element, radiative element 113, is a 2 gigahertz element. Its size was chosen in order to allow the most number of elements on a 5" by 8" microwave circuit board while including the lowest possible frequency in the array.

Element 103 is trapezoidally shaped having an upper longer edge 171 generally parallel to its lower shorter edge 114. In the orientation of FIG. 7, a diagonal $d_1$, constructed from the upper left corner 173 to the lower right corner 174 and a diagonal $d_2$, from the upper right corner 175 to the lower left corner 176 forms an intersection 177, near the middle of radiating element 103.

The distance from the intersection 177, near the center of the radiating element 103 to the lower right, or lower left, corner is designated as distance "A". The distance from the intersection 177 near the to a connecting pin 115 is designated as distance "B". Distance B is approximately one third of the diagonal distance $d_1$ or $d_2$, from the upper corner to the center of each radiating element. Such placement causes the impedance of each radiating element to be about 50 ohms.

The remaining FIGS. relate to the measured performance of the antenna 101 detailed in FIGS. 1–7, as well as an illustration of a hybrid connector, to be explained below. Referring to FIG. 8, a plot of the voltage standing wave ratio versus frequency is shown. This plot was obtained with both of the coaxial connectors 129 and 130 connected and fed with an input signal. This case represents the best performance profile.

In FIG. 8, the plots are more greatly spread than in subsequent plots thus facilitating an explanation thereof. The top plot line represents an approach toward the infinite standing wave ratio. Infinite standing wave ratio equals an operating point wherein 100% of the energy is returned to the source, typically a standard transmitter or amplifier. The line which moves about in vertical extremes is the measured standing wave ratio, and it is labeled "measured" in the figures.

Extremes occur as the electromagnetic wave, at its frequency of transmission, encounters a greater or lesser impedance difference at the antenna. Peaks represent an extreme impedance mismatch and great reflection of energy back to the transmitter. Valleys represent an impedance match and very little reflection of energy back to the transmitter. by the antenna encounters favorable and unfavorable reflection ratios A dashed line labeled 2:1 extends generally constantly displaced from the upper infinity standing wave ratio line. This line indicates the 2:1 standing wave ratio, a benchmark utilized in measuring antenna performance.

Figure 9:
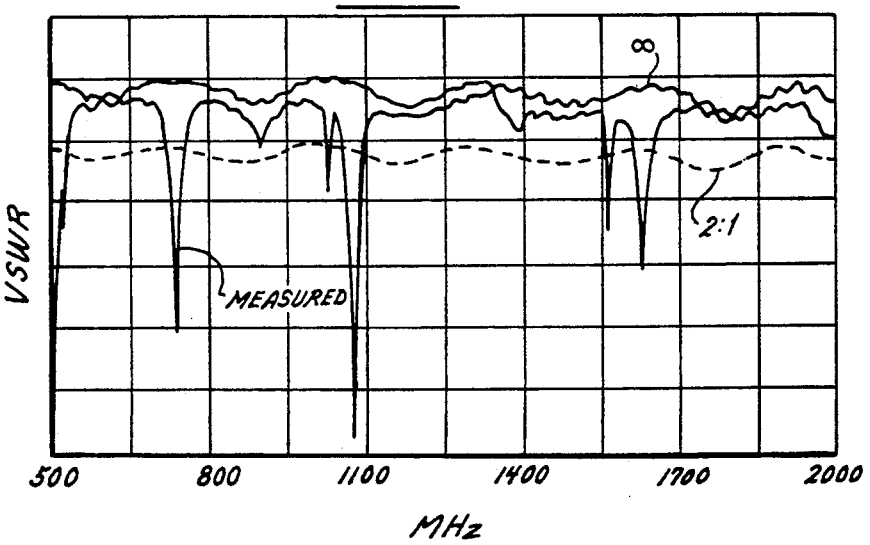
FIG. 9 is a plot of the voltage standing wave ratio versus frequency with port 2 fed and port 1 short circuited.

FIG. 9 illustrates a plot of the voltage standing wave ratio versus frequency with a signal fed into connector 130 (port 2) with connector 129 (port 1) short circuited. The parameters of the plot are identical with those described for FIG. 8. In FIG. 9, the measured standing wave ratio experiences deeper valleys but has more relative area between the 2:1 dashed line and the measured standing wave ratio line.

Figure 10:
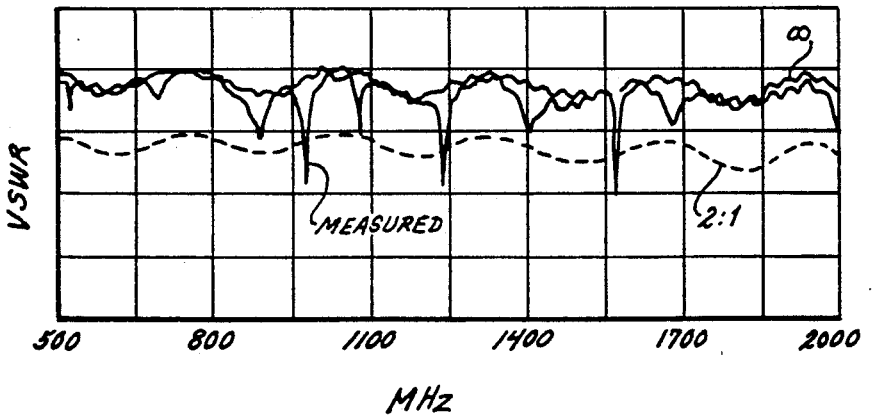
FIG. 10 is a plot of the voltage standing wave ratio versus frequency with port 2 fed and port 1 open circuited.

FIG. 10 illustrates a plot of the voltage standing wave ratio versus frequency with a signal fed into port 2, with port 1 open circuited. Again, the plot parameters are the same as those described for FIG. 8. The measured standing wave ratio function is very close to the infinite standing wave ratio function.

Figure 11:
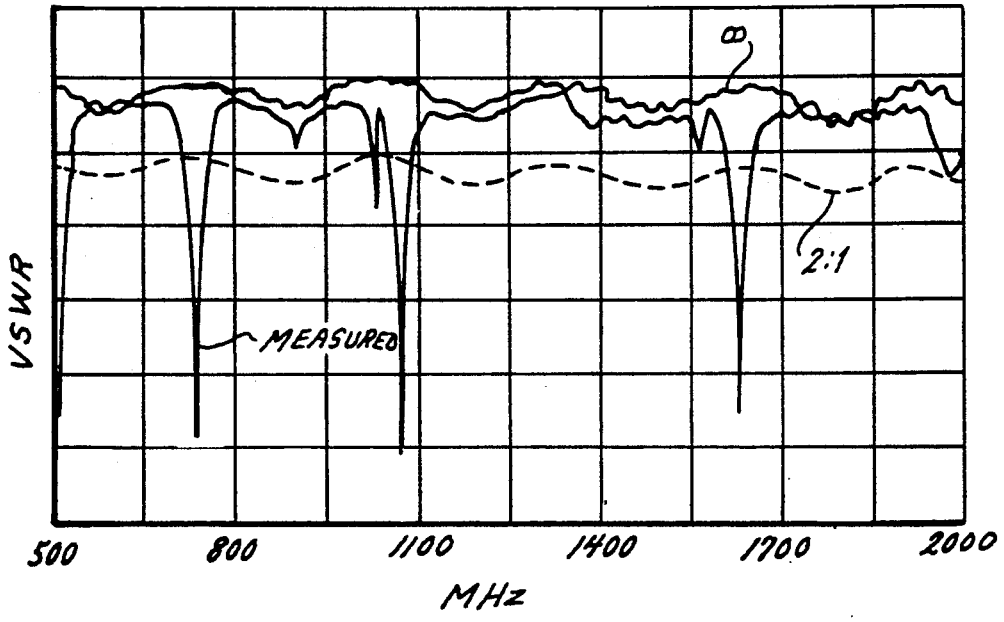
FIG. 11 is a plot of the voltage standing wave ratio versus frequency with port 1 fed and port 2 short circuited.

FIG. 11 illustrates a plot of the voltage standing wave ratio versus frequency with a signal fed into port 1, with port 2 short circuited. FIG. 11 appears similar to FIG. 9 with deep valleys and a measured standing wave ratio much closer to the infinity standing wave ratio line.

Figure 12:
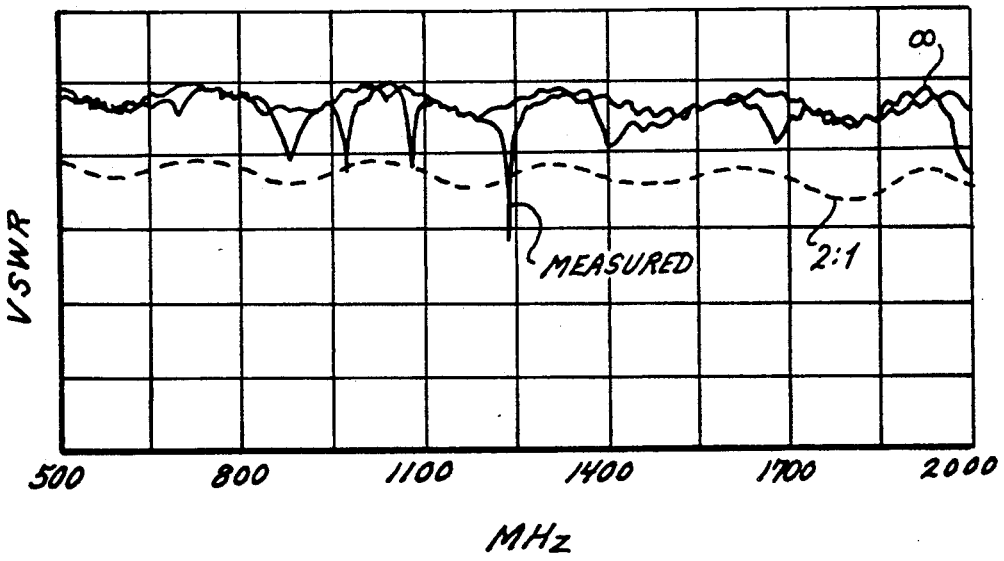
FIG. 12 is a plot of the voltage standing wave ratio versus frequency with port 1 fed and port 2 open circuited.

FIG. 12 illustrates a plot of the voltage standing wave ratio versus frequency with a signal fed into port 1, and port 2 open circuited. FIG. 12 most closely resembles FIG. 10, since the measured standing wave ratio function is extremely close to the infinite standing wave ratio function. Thus, operation with one port open circuited represents the most degraded operating condition. Operation with one port short circuited represents the next most degraded operating condition.

Figure 13:
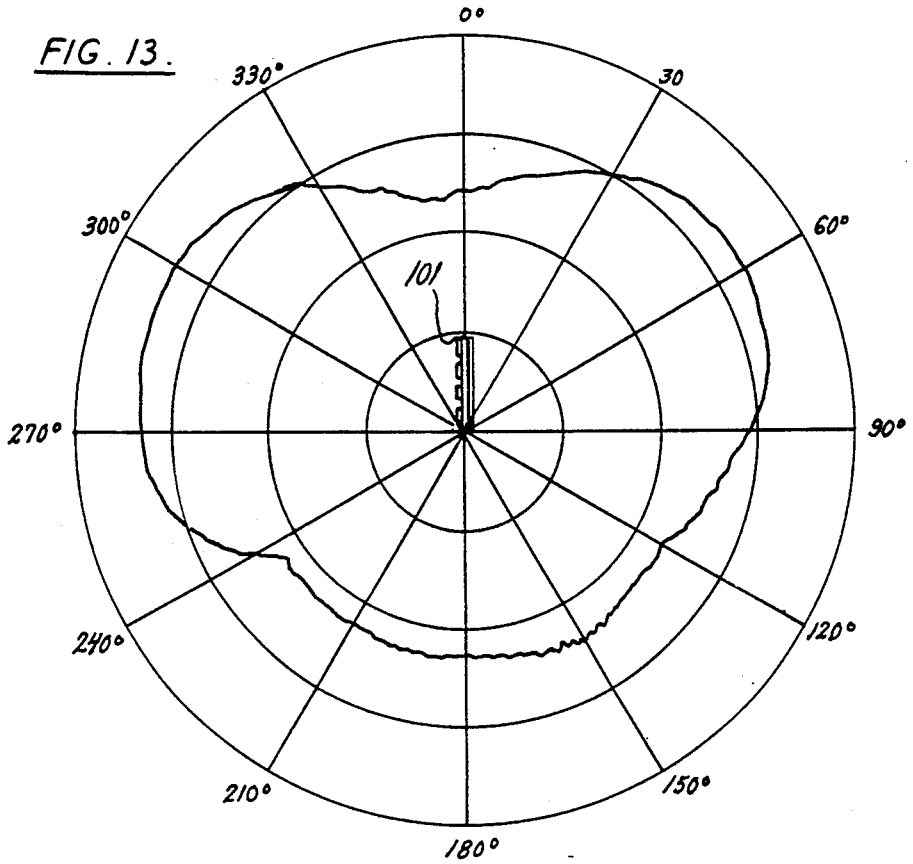
FIG. 13 is a polar plot of electric field strength extending from a point normal to the center of the antenna at 270 degrees, over the top, down around the rearward side, underneath and back to the point normal to the center.

FIG. 13 is a polar plot of electric field strength extending from a point normal to the center of the antenna 101, represented by the 270 degrees point, thence over the top, down around the rearward side, underneath and back to the point normal to the center. A small model of the antenna 101 is shown at the center of the polar plot to indicate relative position on the polar plot to the relative orientation of the antenna 101.

Figure 14:
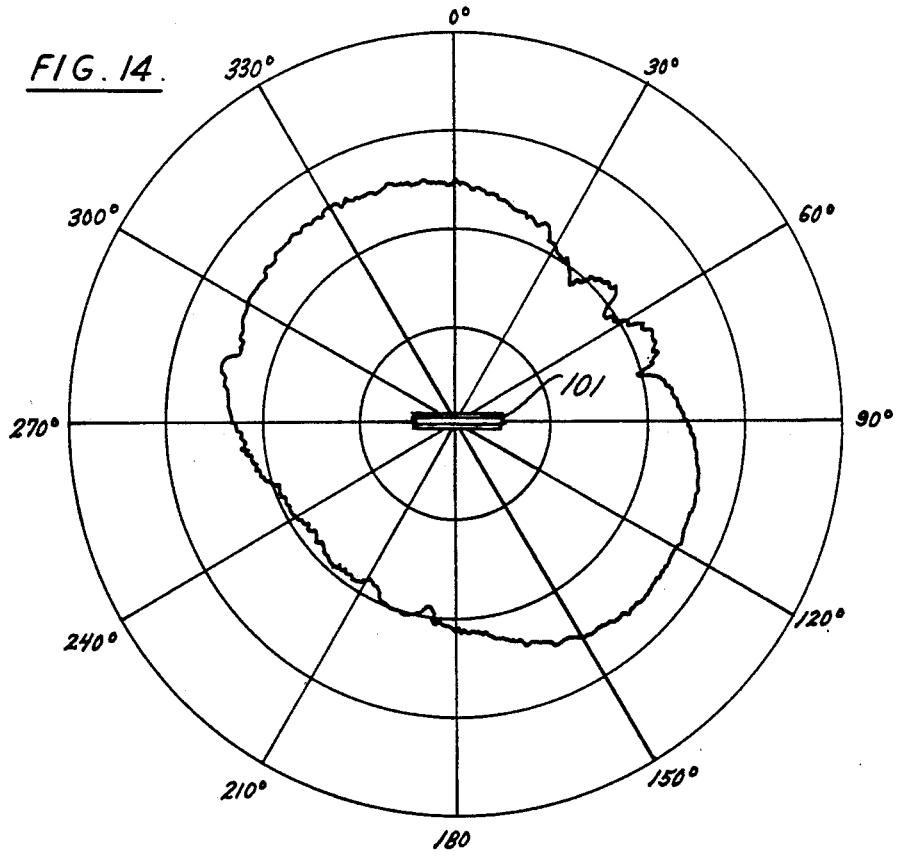
FIG. 14 is a polar plot of electric field strength for the antenna of the present invention measured from a point atop the antenna 360 degrees radially about the antenna, the peripheral point normal to the center at 180 degrees.

FIG. 14 is a polar plot of electric field strength for the antenna 101 of the present invention. The electric field is measured from a point atop the antenna and illustrates the field strength in a radial direction therefrom, 360 degrees radially about antenna 101. The strength is measured about a peripheral point normal to the center of antenna 101. The point normal to the center of the front of antenna 101 is at the 180 degree indication on FIG. 14.

Figure 15:
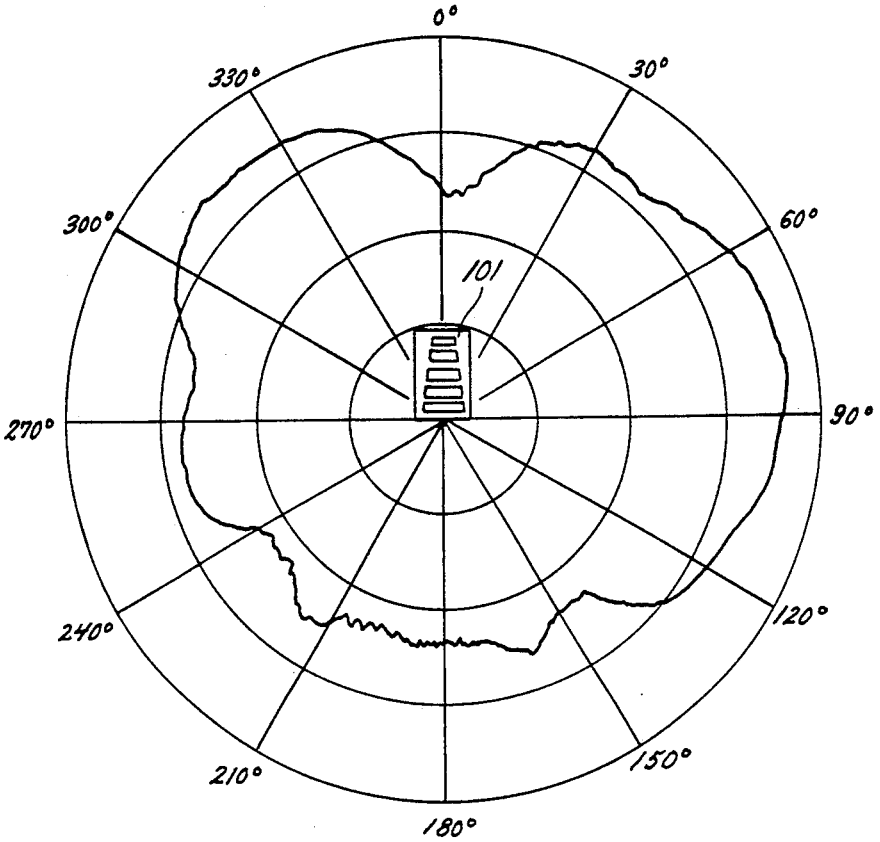
FIG. 15 is a polar plot of electric field strength for the antenna of the present invention measured along the edges of the antenna 360 degrees, the top of the antenna at 0 degrees; and, FIG. 16 is an illustration of the rear section of the antenna of the present invention as in claim 1, but with a hybrid attached.

FIG. 15 is a polar plot of electric field strength for antenna 101 of the present invention measured in the same plane as antenna 101's planar front face 118. If the observer were to move about the periphery of the polar plot looking inwardly, only the thinnest profile of antenna 101 would be visible. A small illustration of antenna 101 appears at the center of FIG. 15 to show its relative position with respect to the polar plot. The antenna is "pointing" in the direction of the observer. The electric field measurements are made "looking into" the antenna 101 at right angles from a line extending normal to FIG. 15. The "top" of the antenna, namely the edge opposite the coaxial feeds, is shown as 180 degrees.

Figure 16:
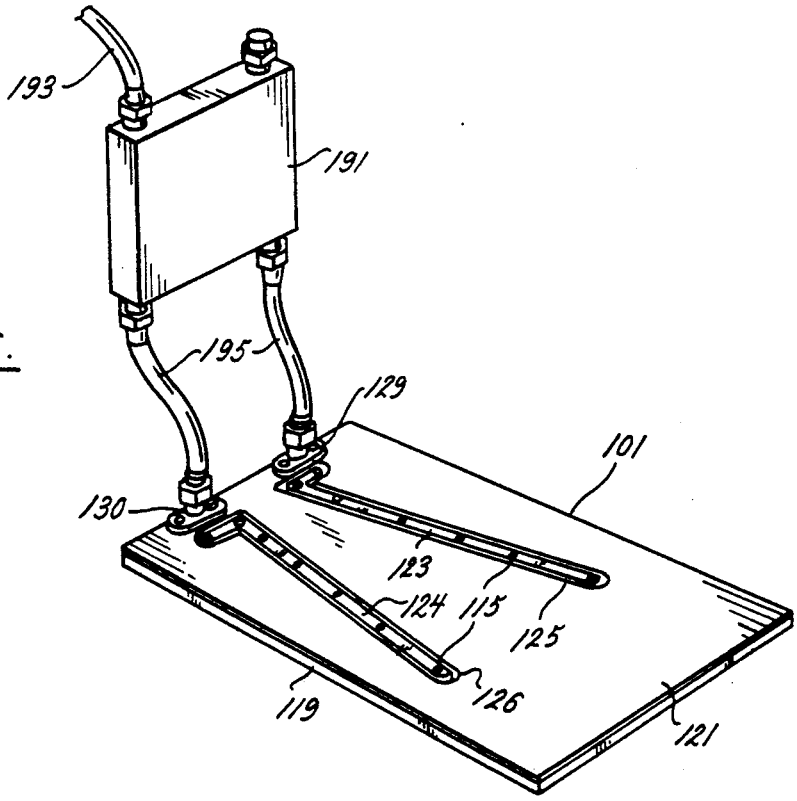

FIG. 16 is an illustration of the rear section of the antenna of the present invention as in claim 1, but with a hybrid 191 attached. Hybrid 191 is used to phase shift one microstrip line with respect to the other so that the array can receive both horizontally and vertically polarized signals from one output connector. As one example, a hybrid manufactured under the trade name "ANAREN" known as the ANAREN 90° hybrid which has a 3dB bandwidth of from about 500 MHz to 2000 MHz, and is commonly commercially available as an "off the shelf" item.

A hybrid 191 is any printed circuit, or other circuit, or any device, microwave or other device or differential path device which causes a phase shift in a signal.

Hybrid 191 is fed from a single piece of coaxial cable 193. Hybrid 191 has a a pair of outputs which attach to antenna 101 by means of two short pieces of coaxial cable 195. Here it is readily shown that antenna 101 can be fed directly by coaxial cable 193 attached to one connector 129 of one side of antenna 101 or to the other connector 130 on the other side of antenna 101. Coaxial cable 193 can also be connected in parallel to connectors 129 and 130 using a splitter (not shown) or other device to permit paralleling the connection cable.

In addition, the presence of the hybrid 191 also affects the optimum frequency for each radiating element. As is illustrated in the table below, the actual and theoretical frequencies both differ from 95% to 80% over the range of radiating elements. Although the values given below pertain to the specific dimensions for one particular embodiment, the effect is expected to be proportional in the case of other radiating elements in other embodiments of the present invention.

TABLE I

RADIATIVE ELEMENT PERFORMANCE. ACTUAL & THEORETICAL WITH AND WITHOUT A HYBRID

| Element | Length (in.) | Diagonal (in.) | Without Hybrid frequency Theory | Without Hybrid frequency Actual | With Hybrid frequency Theory | With Hybrid frequency Actual |
|---|---|---|---|---|---|---|
| 103 | 2.078 | 4.375 | 739 | 795 | 702 | .699 |
| 105 | 1.484 | 3.375 | 1034 | 1100 | 910 | 895 |
| 107 | 1.125 | 2.688 | 1365 | 1382 | 1142 | 1042 |
| 109 | 0.891 | 2.141 | 1723 | 1638 | 1434 | 1379 |
| 111 | 0.688 | 1.688 | 2231 | 2281 | 1819 | 1863 |
| 113 | 0.531 | 1.313 | 2891 | 2996 | 2338 | 2395 |

An explanation of the design of the radiative elements is facilitated by reference to FIG. 7. Note that radiative element 103 extends upwardly and outwardly trapezoidally from normal at an angle ($\alpha$). This angle defines the patch width, and is derived from the theories originated by Dysan, Mittra et al in the 1950's.

Note the distance L, of the radiative element 103 of FIG. 7. Referring back to FIG. 1, the ratio of the distance L of the largest radiative element 103 to the distance L of the next largest radiative element 105 is the same as the ratio of the distance L of radiative element 105 to distance L of radiative element 107, and so on.

| Bandwidth | Phase shift (first to second input) |
|---|---|
| 500-2000 MHz | 90° |

The foregoing disclosure and description of the invention are illustrative and explanatory thereof, and various changes in the materials of construction, physical configuration, types of control, (e.g., electrical, mechanical, etc) as well as in the details of the illustrated embodiments may be made without departing from the spirit and scope of the invention.

What is claimed is:

1. A broad frequency band antenna comprising:

a dielectric planar support having a front side and a back side;

a layer of metallization adhered to said back side of said dielectric planar support;

a plurality of trapezoidally shaped antenna elements affixed to said front side of said dielectric planar support oriented parallel to each other;

a pair of microstrip feedlines on said back side of said dielectric planar support electrically insulated from said layer of metallization;

a plurality of pairs of connecting pins, each connecting pin of a pair of connecting pins electrically joining a microstrip feedline to one of said antenna elements such that each antenna element is electrically joined once to each of said microstrip feedlines;

a pair of transmission lines, each having a first end electrically connected to a different one of said microstrip feedlines, and a second end, said pair of transmission lines extending from said microstrip feedlines through said dielectric planar support to said front side and then extending back through said dielectric planar support to said back side; and a pair of coaxial connectors, each connected to a second end of a different one of said transmission lines, and groundedly affixed to said layer of metallization.

2. The antenna of claim 1 wherein said pair of transmission lines are each surrounded by insulating material as they extend through said dielectric planar support.

3. The antenna of claim 1 further comprising:

a hybrid having a first port connected to one of said pair of coaxial connectors, a second port connected to the other of said pair of coaxial connectors, and a third port.

4. The antenna of claim 3 wherein said hybrid has a band characteristic of from about 500 megahertz to about 2000 megahertz.

5. An antenna comprising:

a dielectric layer having:

a front side; and a back side;

an electrically conductive layer in abutment with said back side of said dielectric layer;

a plurality of trapezoidally shaped electrically conductive elements positioned on said front side of said dielectric layer;

first and second feedlines positioned on said back side of said dielectric layer separated from said electrically conductive layer;

a plurality of first connectors, each trapezoidally shaped electrically conductive element being electrically connected to said first feedline by one of said plurality of first connectors;

a plurality of second connectors, each trapezoidally shaped electrically conductive element being electrically connected to said second feedline by one of said plurality of second connectors; and means connected to said electrically conductive layer and at least one of said feedlines for passage of electrical signals, said means including:

a first transmission line having:

a first end; and a second end, said first end of said first transmission line being connected to said first feedline and extending therefrom through said dielectric layer from side and then extending back through said dielectric layer front side to said back side thereof for passage of electrical signals thereon.

6. The antenna as defined in claim 5 wherein said means connected to said electrically conductive layer and at least one of said feedlines include:

a second transmission line having;

a first end; and a second end, said first end of said second transmission line being connected to said second feedline and extending therefrom through said dielectric layer front side and then extending back through said dielectric layer front side to said back side thereof for passage of electrical signals thereon.

7. The antenna as defined in claim 6 wherein said means connected to said electrically conductive layer and at least one of said feedlines further include:

a first coaxial connector having:

a center conductor connected to said second end of said first transmission line, and a body connected to said electrically conductive layer.

8. The antenna as defined in claim 7 wherein said means connected to said electrically conductive layer and at least one of said feedlines further include:

a second coaxial connector having:

a center conductor connected to said second end of said second transmission line, and a body connected to said electrically conductive layer.

9. The antenna as defined in claim 6 wherein said first and second transmission lines each are electrically insulated from said electrically conductive layer.

10. The antenna as defined in claim 8 wherein said means connected to said electrically conductive layer and at least one of said feedlines further include:

a hybrid having:

a first port connected to said first coaxial connector;

a second port connected to said second coaxial connector; and a third port.

11. An antenna with an omni-directional radiation pattern over a wide band of frequencies comprising:

an electrically conductive sheet;

a plurality of trapezoidally shaped electrically conductive elements of graduated size supported generally parallel to, spaced from, and electrically isolated from said electrically conductive sheet;

first and second feedlines positioned adjacent said electrically conductive sheet and electrically separated therefrom;

a plurality of first connectors, each trapezoidally shaped electrically conductive element being electrically connected to said first feedline by one of said plurality of first connectors;

a plurality of second connectors, each trapezoidally shaped electrically conductive element being electrically connected to said second feedline by one of said plurality of second connectors; and.

means connected to said electrically conductive sheet and at least one of said feedlines for passage of electrical signals, each element of said plurality of trapezoidally shaped electrically conductive elements having:

a first edge;

a second edge parallel to said first edge and being shorter in length than said first edge;

a left side edge; and a right side edge, said side edges each extending from said first edge to said second and forming an included angle with said second edge which is similar for all of said side edges of said elements and is greater than 90°, said electrically conductive elements being graduated in size so that a diagonal length from an intersection of said first edge and said left edge to an intersection of said second edge and said right edge of a larger electrically conductive element divided by a diagonal length from an intersection of said first edge and said left edge to an intersection of said second edge and said right edge of an adjacent smaller electrically conductive element results in a relatively constant ratio.

12. The antenna as defined in claim 11 wherein each element of said plurality of trapezoidally shaped electrically conductive elements is positioned with said left side edges in alignment and with said right side edges in alignment.

13. The antenna as defined in claim 11 wherein said second connectors connect to said trapezoidally shaped electrically conductive elements on a diagonal line between said intersection of said first edge and said left edge to said intersection of said second edge and said right edge.

14. The antenna as defined in claim 11 wherein said means connected to said electrically conductive sheet and at least one of said feedlines include:

a first coaxial connector having:

a center conductor connected to said second end of said first transmission line, and a body connected to said electrically conductive sheet.

15. The antenna as defined in claim 14 wherein said means connected to said electrically conductive sheet and at least one of said feedlines further include:

a second coaxial connector having:

a center conductor connected to said second end of said second transmission line, and a body connected to said electrically conductive sheet.

16. The antenna as defined in claim 11 wherein said means connected to said electrically conductive sheet and at least one of said feedlines further include:

a hybrid having:

a first port electrically connected to said first feedline;

a second port electrically connected to said second feedline; and a third port electrically connected to said first and second ports within said hybrid.

17. The antenna as defined in claim 11 further including:

a dielectric sheet which is generally planar, each of said plurality of trapezoidally shaped electrically conductive elements being formed from thin conductive sheets attached to said dielectric sheet.

18. The antenna as defined in claim 17 wherein said means connected to said electrically conductive sheet and at least one of said feedlines include:

a first transmission line having;

a first end; and a second end, said first end of said first transmission line being connected to said first feedline and extending therefrom through said dielectric sheet and then looping back through said dielectric sheet for passage of electrical signals thereon; and a second transmission line having;

a first end; and a second end, said first end of said second transmission line being connected to said second feedline and extending therefrom through said dielectric sheet and then looping back through said dielectric sheet for passage of electrical signals thereon.

19. An antenna with an omni-directional radiation pattern over a wide band of frequencies comprising:

an electrically conductive sheet;

a plurality of trapezoidally shaped electrically conductive elements of graduated size supported generally parallel to, spaced from, and electrically isolated from said electrically conductive sheet;

first and second feedlines positioned adjacent said electrically conductive sheet and electrically separated therefrom;

a plurality of first connectors, each trapezoidally shaped electrically conductive element being electrically connected to said first feedline by one of said plurality of first connectors;

a plurality of second connectors, each trapezoidally shaped electrically conductive element being electrically connected to said second feedline by one of said plurality of second connectors;

means connected to said electrically conductive sheet and at least one of said feedlines for passage of electrical signals; and a dielectric sheet which is generally planar, each of said plurality of trapezoidally shaped electrically conductive elements being formed from thin conductive sheets attached to said dielectric sheet, wherein said means connected to said electrically conductive sheet and at least one of said feedlines include:

a first transmission line having;

a first end; and a second end, said first end of said first transmission line being connected to said first feedline and extending therefrom through said dielectric sheet and then looping back through said dielectric sheet for passage of electrical signals thereon; and a second transmission line having;

a first end; and a second end, said first end of said second transmission line being connected to said second feedline and extending therefrom through said dielectric sheet and then looping back through said dielectric sheet for passage of electrical signals thereon.

* * * * *